US005107655A

United States Patent [19]

Lindgren

[11] Patent Number: 5,107,655

[45] Date of Patent: Apr. 28, 1992

[54] PROFILED SECTION FOR DOOR-LEAVES

[75] Inventor: Bengt Lindgren, Sollentuna, Sweden

[73] Assignee: Termofrost AB, Kista, Sweden

[21] Appl. No.: 469,850

[22] Filed: Jan. 19, 1990

[30] Foreign Application Priority Data

Jan. 20, 1989 [SE] Sweden ..... 8900210

[51] Int. Cl.[5] ..... E06B 3/66

[52] U.S. Cl. ..... 52/788; 52/790

[58] Field of Search ..... 52/398, 399, 400, 208, 52/172, 788, 789, 790, 656; 428/34

[56] References Cited

U.S. PATENT DOCUMENTS

| | | | |
|---|---|---|---|
| 3,872,198 | 3/1975 | Britton | 428/34 |
| 3,889,434 | 7/1975 | Shelver | 52/398 |
| 4,006,569 | 2/1977 | Kain | 52/400 |
| 4,500,572 | 2/1985 | Francis | 52/172 |

FOREIGN PATENT DOCUMENTS

| | | | |
|---|---|---|---|
| 3404077 | 10/1985 | Fed. Rep. of Germany | 428/34 |

*Primary Examiner*—John E. Murtagh
*Attorney, Agent, or Firm*—Nies, Kurz, Bergert & Tamburro

[57] ABSTRACT

A door-leaf profiled section for glass doors and windows, and particularly for glass doors of the kind used between a room a refrigerator or freezer space, the profiled section preferably being made of aluminum and being intended to embrace the edges of a double or triple glazing assembly, and including a substantially U-shaped channel in which the glazing assembly is intended to be inserted and there glued. The invention is characterized in that the U-shaped channel (4), seen in cross section, includes at least three abutment surfaces (7, 8, 9) intended for abutment with a glazing assembly (2) inserted into the channel, such that one side (10) of the glazing assembly (2) will abut one of the abutment surfaces (7), and such that the opposing side (11) of the assembly will abut two of the abutment surfaces (8, 9), these latter abutment surfaces (8, 9) being spaced from one another. Two of the abutment surfaces (7, 8) form the mouth of the U-shaped channel (4) and are spaced apart at a distance which corresponds to the thickness of the glazing assembly (2), whereas the remainder of the U-shaped channel has a width which is greater than the width of the glazing assembly. The profiled section includes fastener means (13, 14) on the bottom of the U-shaped channel. Seen in cross section, the fastener means includes two projections (13, 14) which extend parallel with the U-shaped channel, from the bottom of the channel towards the mouth thereof. The free-ends of the projection (13, 14) are provided with a respective widened part (15, 16).

7 Claims, 2 Drawing Sheets

PROFILED SECTION FOR DOOR-LEAVES

The present invention relates to a profiled section intended for glazed doors and windows and particularly for glazed doors of the kind which are used between a room and a refrigerator or freezer space.

Various designs of doors of this kind are known to the art, in which a double glazing assembly or triple glazing assembly is fitted into a profiled, aluminium section or surround which embraces the outer edge surfaces of the glazing. The manufacture of such doors or windows commences with a double-glazing or triple-glazing assembly, in which the glass sheets are fixated relative to one another. The outer edge surfaces of the glazing assembly are coated with glue and the unit is fitted to the aluminium sections and held in position relative to the aluminium section until the glue has hardened sufficiently to retain the unit in its correct position relative to the aluminium section.

The profiled aluminium sections normally include a U-shaped channel into which the glazing assembly is inserted. Protruding from the bottom of the channel is a bead, which is intended to come into contact with the glue, therewith gluing the profiled sections to the glazing assembly. In the case of doors of this kind, the profiled sections are responsible for the major part of the mechanical strength of the doors.

The present invention is based on the concept of utilizing the mechanical strength of both the profiled sections and the glazing assemblys themselves to a greater extent than in known doors and windows of this kind.

The present invention relates to a profiled section of novel configuration with which a strong bond is obtained between the profiled section and the glazing assembly. The inventive profiled section will also enable said section to be fitted more readily in relation to a glazing assembly than is possible with known doors.

More specifically, the invention relates to a profiled section for glass doors and windows, and particularly for glass doors of the type used between a room and a refrigerator or freezer space, said profiled section preferably being made of aluminium and being intended to embrace the edge surfaces of a double-glazing or triple-glazing assembly. The profiled section includes a substantially U-shaped channel into which the glazing assembly is inserted and there glued. The invention is characterized in that when seen in cross section, the U-shaped channel includes at least three abutment surfaces for abutment with a glazing assembly inserted in said channel, such that one side surface of said unit will abut one of said abutment surfaces and such that the opposite side-surface of the unit will abut two of the abutment surfaces, these latter abutment surfaces being spaced from one another; in that two of the abutment surfaces define the mouth of the U-shaped channel and are mutually spaced by a distance which corresponds to the thickness of the glazing assembly, whereas the remainder of the U-shaped channel has a width which is greater than the thickness of said unit; and in that the profiled section includes on the bottom of the U-shaped channel fastener elements which, seen in one cross-section, comprise at least one projection which extends parallel with the U-shaped channel, from the bottom of said channel towards the mouth thereof, and the free end of which projection has a widened part.

The invention will now be described in more detail with reference to an exemplifying embodiment thereof illustrated in the accompanying drawings, in which FIG. 1 is a cross-sectional view of a door-leaf profiled section constructed in accordance with the invention;

Figure 1:
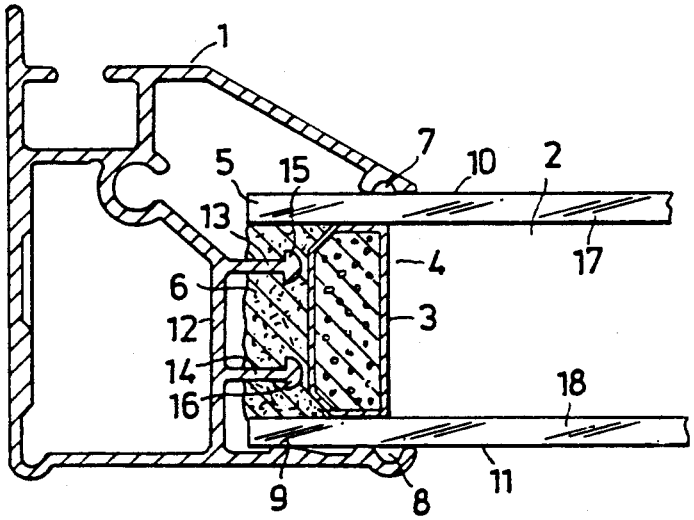
Figure 2:
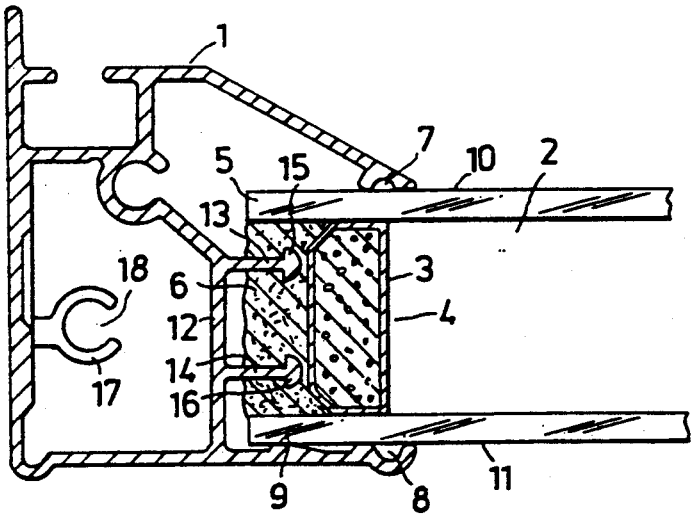
FIG. 2 illustrates a modified door-leaf profiled section constructed in accordance with the invention.
Figure 3:
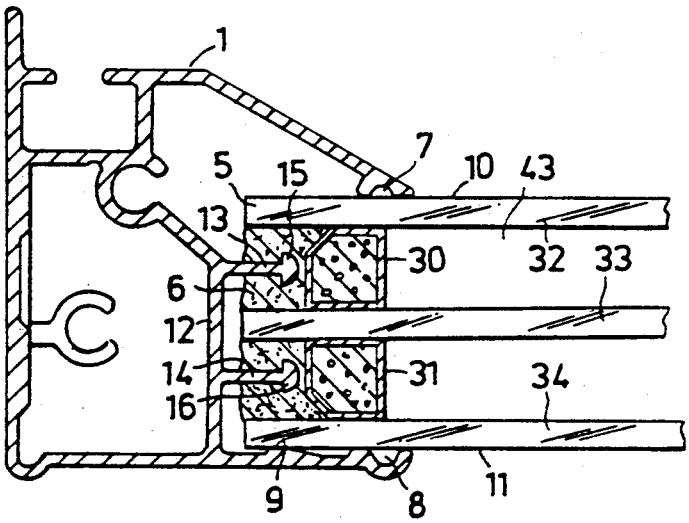
FIG. 3 illustrates the profiled section of FIG. 2 fitted with triple glazing.
Figure 4:
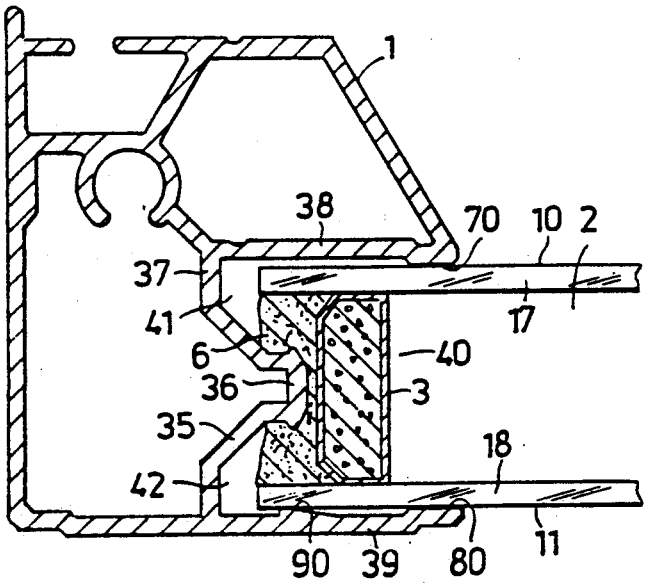
FIG. 4 illustrates a modified profiled section.

FIGS. 1, 2 and 3 illustrate a profiled section 1 intended for glass doors and windows, and particularly for glass doors of the kind used between a room and a refrigerator or freezer space. The room may be a living room, a restaurant room or a grocery store or shop. The profiled section is preferably made of aluminium and is intended to embrace the edge-surfaces of a double or triple glazing assembly. The embodiments illustrated in FIGS. 1, 2 and 4 are fitted with double-glazing 2, where the glass sheets are mutually spaced with the aid of a so-called spacer 3. The glass sheets are secured to the spacer with the aid of butyl glue, for instance. The profiled section 1 includes a U-shaped channel 4, in which the edge surface 5 of the glazing assembly 2 is fitted and there glued. The glue is referenced 6 in the figures and may be of any appropriate kind, although the glue will preferably be a polysulphide glue or some other so-called hot-melt glue.

In accordance with the present invention, when seen in one cross-section, the U-shaped channel includes at least three abutment surfaces 7, 8, 9 intended for abutment with the glazing assembly 2 inserted in the channel 4, such that one side 10 of the glazing assembly will lie against one of the abutment surfaces, the abutment surface 7 of the illustrated embodiment;and such that the opposite side-surface 11 of the unit 2 will lie against two abutment surfaces 8, 9, these latter abutment surafces 8, 9 being spaced from one another. Two of the abutment surfaces, the abutment surafces 7, 8 of the illustrated embodiment, define the mouth of the U-shaped channel 4 and are spaced apart at a distance which corresponds to the thickness of the glazing assembly, whereas the remainder of the U-shaped channel has a width which exceeds the thickness of said unit.

In accordance with one preferred embodiment of the invention, the abutment surfaces 7, 8, 9 have a short length in relation to the depth of the U-shaped channel 4, preferably a length shorter than one-fifth of the depth of the U-shaped channel. This enables the profiled sections to be fitted quickly and readily to the edge surfaces of the glazing assembly and positioned relative thereto.

The bottom of the U-shaped channel 4 has provided thereon fastener means 13, 14 which, when seen in cross-section, includes at least one projection 13, 14 which extends parallel with the U-shaped channel, from the bottom of said channel 4 towards the mouth 12 thereof. The embodiment illustrated in FIGS. 1, 2 and 3 includes two such projections. The free end of respective projections 13, 14 has a widened part 15, 16 which co-acts with the glue 6 such as to form a strong bond between the profiled sections and the glazing assembly. The aforesaid spacer is positioned at a location between the glass sheets 17, 18 slightly inwards of one end of said sheets, such that the spacer and the two glass sheets form a U-shaped recess. This recess is filled with glue, whereafter the profiled sections are pushed onto the edge-surfaces of the glazing assembly. The projections 13, 14 will thus enter the glue to an extent in which the widened parts of said projections are located close to the spacer, as illustrated in FIG. 1. The glue will therewith surround substantially the whole of each projection. The widened parts 15, 16 are operative to provide a very strong bond between the profiled sections and the glazing assembly. The glue binds firmly to both the spacer and the inner surfaces of the glass sheets.

As will be seen from FIG. 1, the U-shaped channel has only a partial bottom 12. This enables a copious quantity of glue to be used so as to ensure that a good glue join is obtained, since excess glue will be pressed-out from the U-shaped channel at the place where said channel lacks a bottom.

FIG. 2 illustrates a modified profiled section which includes a further element 17 which incorporates an open groove 18, as shown in said figure. The open groove 18 is intended to co-act with a torsion spring for damping movement of the door automatically as the door is closed. One end of the torsion spring is mounted non-pivotally in the frame in which the door is hung, whereas the other end of the spring is connected non-pivotally to the element 17.

According to another preferred embodiment shown in FIG. 3, the profiled section 1 has a cross-section identical with the section shown in FIG. 2, but each of the two projections 13, 14 are positioned so as to extend in between respective outer glass-sheets and the centre glass sheet of a triple-glazing assembly, as illustrated in FIG. 3. In FIG. 3, the reference numerals 30 and 31 identify two so-called spacers, and the reference numerals 32, 33 and 34 identify the three glass sheets of a triple glazing assembly 43.

FIG. 4 illustrates a modified door-leaf profile-section in which solely a single projection 35 having a widened part 36 on the free end thereof is provided. The three abutment surfaces 70, 80, 90 of this embodiment are modified slightly in comparison with the abutment surfaces 7, 8, 9 of the embodiment illustrated in FIGS. 1, 2 and 3, but have the same function.

The U-shaped channel 40 of the FIG. 4 embodiment has a full bottom 37, with which walls 38, 39 connect, but the volume 41, 42 which remains subsequent to gluing with a normal quantity of glue is sufficient for a copious amount of glue to be used.

According to one preferred embodiment of the invention, the profiled sections havemutually the same cross-sectional shape along the whole of their lengths.

The profiled sections are screwed together, subsequent to fitting said sections onto the side-edges of the glazing assembly. Because the profiled sections are joined together and are also firmly bonded to the glazing assembly, there is obtained an integrated structure in which the mechanical strength of both the profiled sections and the glazing assembly cooperate.

The use of three abutment surfaces 7, 8, 9; 70, 80, 90 instead of a U-shaped channel with totally parallel walls facilitates fitting of the profiled sections to a glazing assembly. Furthermore, as before mentioned, a copious quantity of glue can be used.

It will be apparent from the aforegoing that the inventive door-leaf profiled-section will provide a door or a window in which the mechanical strength of the profiled section and of the glasing assembly cooperate with one another to provide a robust structure, and that the profiled sections can be fitted readily to the glazing assembly.

Furthermore, the profiled section will prevent moisture from diffusing from the cold space to the warmer space, such diffusion occurring in known doors between the profiled section and the edges of the glass sheets. Consequently, it is necessary in the case of known doors to fit a seal between the profiled section and the edgesof the glazing assembly. The need of such a seal is obviated by the inventive profiled section.

It will be understood that the configuration of the profiled section can be varied.

Consequently, the present invention is not restricted to the aforedescribed embodiments and modifications can be made within the scope of the following claims.

What is claimed and desired to be secured by Letters Patent is:

1. A door-leaf profiled section for glass doors and windows, particularly for glass doors of the kind used between a room and a refrigerator door or freezer space, said profiled section being made of material shaped to embrace the edge surfaces of a plural sheet glazing assembly, said profiled section including a substantially U-shaped channel in which the edges of the glazing assembly are inserted and there glued, wherein said U-shaped channel (4; 40), seen in cross-section, includes at least three abutment surfaces (7, 8, 9; 70, 80, 90) intended for abutment with the edge side surfaces of said glazing assembly (2; 43) fitted in siad channel, such that one side surface (10) of said glazing assembly (2; 43) will abut one of the abutment surfaces (7; 70) and such that the opposite side surface (11) of said glazing assembly will abut two of said abutment surfaces (8, 9; 80, 90), these latter two abutment surfaces (8, 9; 80, 90) being spaced from one another; said one and one of said two abutment surfaces (7, 8; 70, 80) define the mouth of the U-shaped channel (4; 40) and are spaced apart a distance corresponding tothe thickness of the glazing assembly (2; 43) and the remainder of the U-shaped channel has a width which is greater than the thickness of said glazing assembly; wherein the profiled section includes fastener means (13, 14; 35) on a bottom-forming surface of the U-shaped channel, said fastener means including, when viewed in cross-section, at least one projection (13, 14; 35) which extends parallel with the U-shaped channel from the bottom-forming surface of said channel towards but terminating below the mouth thereof; wherein each said at least one projection (13, 14; 35) is provided at its respective free end with a widened part (15, 16; 36); spacer means between and bonded to the facing surfaces of adjacent sheets of the glazing assembly around and inset from the edges of said sheets a distance less than the length of said projections from the bottom-forming surface of said channel wherein each said at least one projection is positioned so as to project with its said free end and widened part located between edge side surfaces of adjacent sheets of said plural glazing assembly; and wherein glue is placed between the facing edge surfaces of the sheets of said plural glazing assembly and against said spacer means to bond and interlock said projections, said sheets and said glue as an inter-related structure with the edges of said sheets spaced-apart from the bottom-forming surface of said U-shaped channel, enabling excess portions of said glue, displaced by said projections, to be extruded from between the glass sheets into the space between the bottom-forming surface of the U-shaped channel and the edges of said sheets.

2. A profiled section according to claim 1, wherein each of the abutment surfaces (7, 8, 9; 70, 80, 90) have a short length in relation to the depth of the U-shaped channel (4; 40).

3. A profiled section according to claim 1, wherein said plural sheet glazing assembly is a triple glazing assembly and said fastener means (13, 14) are two in number and are positioned so as to individually project in between respective outer glass-sheets and the center glass-sheet of said triple glazing assembly.

4. A profiled section according to claim 1, characterized in that the profiled section has the same cross-sectional shape along the whole of its length.

5. A profiled section according to claim 1, characterized in that the profiled section includes an element (17) which incorporates an open groove (18) for co-action with a torsion spring operative to dampen movement of the door automatically when closing said door.

6. A profiled section as defined in claim 1, wherein the material, from which said profiled section is made is aluminum.

7. A profiled section as defined in claim 2, wherein said short length of each said abutment surface has a length dimension shorter than one-fifth of the depth dimension of the U-shaped channel.

* * * * *